US009120584B2

(12) United States Patent
Santi

(10) Patent No.: US 9,120,584 B2
(45) Date of Patent: Sep. 1, 2015

(54) FOLDING UNIT FOR POURABLE FOOD PRODUCT PACKAGING MACHINES

(75) Inventor: Franco Santi, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 848 days.

(21) Appl. No.: 13/386,055

(22) PCT Filed: Aug. 11, 2010

(86) PCT No.: PCT/EP2010/061712
§ 371 (c)(1),
(2), (4) Date: Jan. 20, 2012

(87) PCT Pub. No.: WO2011/018484
PCT Pub. Date: Feb. 17, 2011

(65) Prior Publication Data

US 2012/0122642 A1 May 17, 2012

(30) Foreign Application Priority Data

Aug. 11, 2009 (EP) ..... 09167649

(51) Int. Cl.
*B31B 1/26* (2006.01)
*B65B 7/18* (2006.01)
*B65B 51/14* (2006.01)

(52) U.S. Cl.
CPC ..... *B65B 7/18* (2013.01); *B65B 51/144* (2013.01); *B65B 51/146* (2013.01)

(58) Field of Classification Search
USPC ..... 53/449, 375.5, 374.9, 370.6, 374.7, 53/375.2, 357.7, 387.3, 379; 493/162, 79, 493/151, 231, 243, 353, 405, 68–69
See application file for complete search history.

(56) References Cited

U.S. PATENT DOCUMENTS 2,455,304 A * 11/1948 Guyer ..... 493/129
2,490,299 A * 12/1949 Hennessey ..... 493/464
(Continued)

FOREIGN PATENT DOCUMENTS

CN 1203879 A 1/1999
CN 1721276 A 1/2006
(Continued)

OTHER PUBLICATIONS

Decision to Grant dated Jul. 18, 2014, issued in corresponding Russian Patent Application No. 2012108719, and an English translation of the Russian Office Action. (14 pgs).
(Continued)

*Primary Examiner* — Sameh Tawfik
(74) *Attorney, Agent, or Firm* — Buchanan Ingersoll & Rooney PC

(57) ABSTRACT

A folding unit for producing packages of pourable food products from sealed packs having a longitudinal first axis and comprising at least one end tab to be folded and projecting in the direction of longitudinal first axis; unit comprises a conveying member fed with a plurality of packs and which feeds the pack along a forming path, and folding device interacting with each pack along forming path to fold first end tab pack; folding device comprises a plurality of surfaces carried by conveying member and cooperating with a central zone of end tab of a pack, and movable between a first position and a second position with respect to pack with which it cooperates; folding device comprises a plurality of cams carried by conveying member and each cooperating, with a surface for moving it between first and second positions.

8 Claims, 9 Drawing Sheets

(56) References Cited

U.S. PATENT DOCUMENTS

| | | | | | |
|---|---|---|---|---|---|
| 3,002,328 | A | * | 10/1961 | Monroe et al. | 53/370.8 |
| 4,063,403 | A | * | 12/1977 | Bergstein et al. | 53/370.6 |
| 4,776,147 | A | * | 10/1988 | Konzal et al. | 53/373.9 |
| 5,966,899 | A | * | 10/1999 | Fontanazzi | 53/374.7 |
| 2009/0113848 | A1 | | 5/2009 | Santi | |
| 2009/0193763 | A1 | | 8/2009 | Fontanazzi et al. | |
| 2012/0122642 | A1 | * | 5/2012 | Santi | 493/162 |

FOREIGN PATENT DOCUMENTS

| | | | | |
|---|---|---|---|---|
| CN | 101395063 | A | | 3/2009 |
| EP | 0061663 | A2 | | 10/1982 |
| EP | 1616796 | A1 | | 1/2006 |
| EP | 1726526 | A1 | | 11/2006 |
| FR | 2821607 | A1 | | 9/2002 |
| JP | 56-48901 | A | | 5/1981 |
| JP | 11-188805 | A | | 7/1999 |
| JP | 2006027734 | A | * | 2/2006 |
| RU | 2374153 | C2 | | 11/2009 |
| WO | 2006122962 | A1 | | 11/2006 |

OTHER PUBLICATIONS

International Search Report (PCT/ISA/210) issued on Oct. 8, 2010, by European Patent Office as the International Searching Authority for International Application No. PCT/EP2010/061712.

Written Opinion (PCT/ISA/237) issued on Oct. 8, 2010, by European Patent Office as the International Searching Authority for International Application No. PCT/EP2010/061712.

Office Action issued on Apr. 22, 2014, by the Japanese Patent Office in corresponding Japanese Patent Application No. 2012-524232, and an English Translation of the Office Action. (7 pages).

English language version of Office Action issued on Nov. 19, 2012, by the Chinese Patent Office in corresponding Chinese Patent Application No. 201080036201.7 (9 pages).

* cited by examiner

FOLDING UNIT FOR POURABLE FOOD PRODUCT PACKAGING MACHINES

TECHNICAL FIELD

The present invention relates to a folding unit for packaging machines for continuously producing sealed packages of pourable food products from a tube of packaging material.

BACKGROUND ART

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or of mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

The tube is filled continuously downwards with the sterilized or sterile-processed food product, and is sealed and then cut along equally spaced cross sections to form pillow packs, which are then fed to a folding unit to form the finished, e.g. substantially parallelepiped-shaped packages.

More specifically, the pillow packs substantially comprise a parallelepiped-shaped main portion; and opposite top and bottom end portions projecting laterally on opposite sides of the main portion and defining respective triangular end flaps to be folded onto the main portion.

A longitudinal sealing strip, formed when sealing the packaging material to form the vertical tube, extends along the pillow packs; and the end portions of each pillow pack have respective transverse sealing seams perpendicular to the relative longitudinal sealing strip and defining respective end tabs projecting from the top and bottom of the pack.

The end portions of each pillow pack taper towards the main portion from the respective end tabs, and are pressed towards each other by the folding unit to form flat opposite end walls of the pack, while at the same time folding the end flaps onto respective walls of the main portion.

Packaging machines of the above type are known, in which the pillow packs are folded to form the parallelepiped-shaped packages by means of folding units as disclosed for example in EP-A-1726526 in the name of the same Applicant.

Folding units disclosed in EP-A-1726526 substantially comprise:

- a chain conveyor feeding packs along a forming path from a supply station to an output station;
- a fixed elongated guide member, which is positioned facing and at a distance from the conveyor chain and cooperates cyclically with each pack to flatten respective top end portion of the pack and so fold respective tab onto such top end portion; and
- folding means cooperating cyclically with each pack to flatten respective bottom end portions and so fold respective tab onto bottom end portion.

More precisely, folding means comprise a plurality of movable plates at least partly defining relative links of chain conveyor and hinged to such relative links.

Each plate defines an impact surface which receives relative pack by tabs of relative bottom portion and rotates between a first and a second operating position.

More specifically, in the first operating position assumed by each plate along an initial portion of forming path, relative impact surface forms with axis of the relative pack, an angle of over 90 degrees so as to fold the pack in the travelling direction of packs along forming path. Differently, in the second operating position, assumed along the remaining portion of forming path, impact surface is rotated towards pack, with which it cooperates to complete folding of relative tab onto pack.

Folding unit further comprises a fixed first cam to move impact surfaces from the relative second to the relative first operating position and a fixed second cam device located immediately upstream from the supply station and intended to move impact surface from the relative first to the relative second operating positions.

Accordingly, folding action relies substantially on the energy associated to the impact between impact surface and pack bottom end.

As a consequence, folding action relies substantially on the fact that the packs are fed to the folding action at a certain speed value. In other words, folding action can be effectively performed only when the output rate of packaging machine is higher than a certain value.

A need is felt within the industry to correctly fold the tab of pack bottom end portion even when the pack speed is particularly low, so as to obtain a folding unit suitable for packaging machine having relatively low output rate.

Furthermore, a need is felt within the industry to reduce the stresses onto packs, so as to improve the overall folding quality of packages.

A need is also felt within the industry to meet the above-identified requirement with reference to packs made by a wide range of packaging materials, especially with particularly hard packaging materials.

Finally, a need is felt within the industry to easily fold different kind of packages having relative bottom tab more or less pressed onto relative main portions.

DISCLOSURE OF INVENTION

It is an object of the present invention to provide a folding unit for a pourable food product packaging machine, designed to meet at least one of the above-identified requirements.

According to the present invention, there is provided a folding unit for a pourable food product packaging machine, as claimed in Claim 1.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
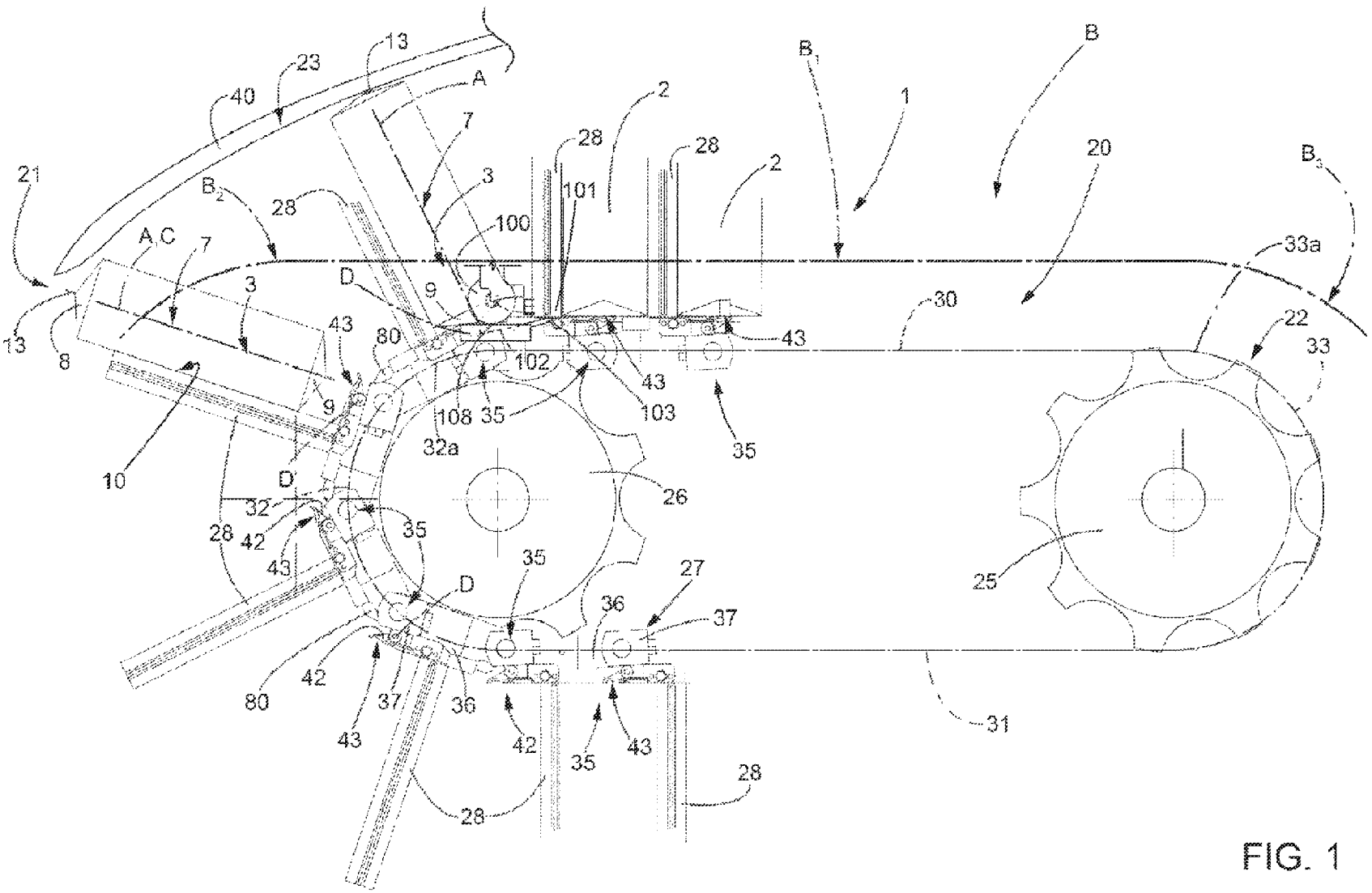
FIG. 1 shows a side view, with parts removed for clarity, of a folding unit in accordance with the present invention for producing packages of pourable food products from sealed pillow packs.
Figure 2:
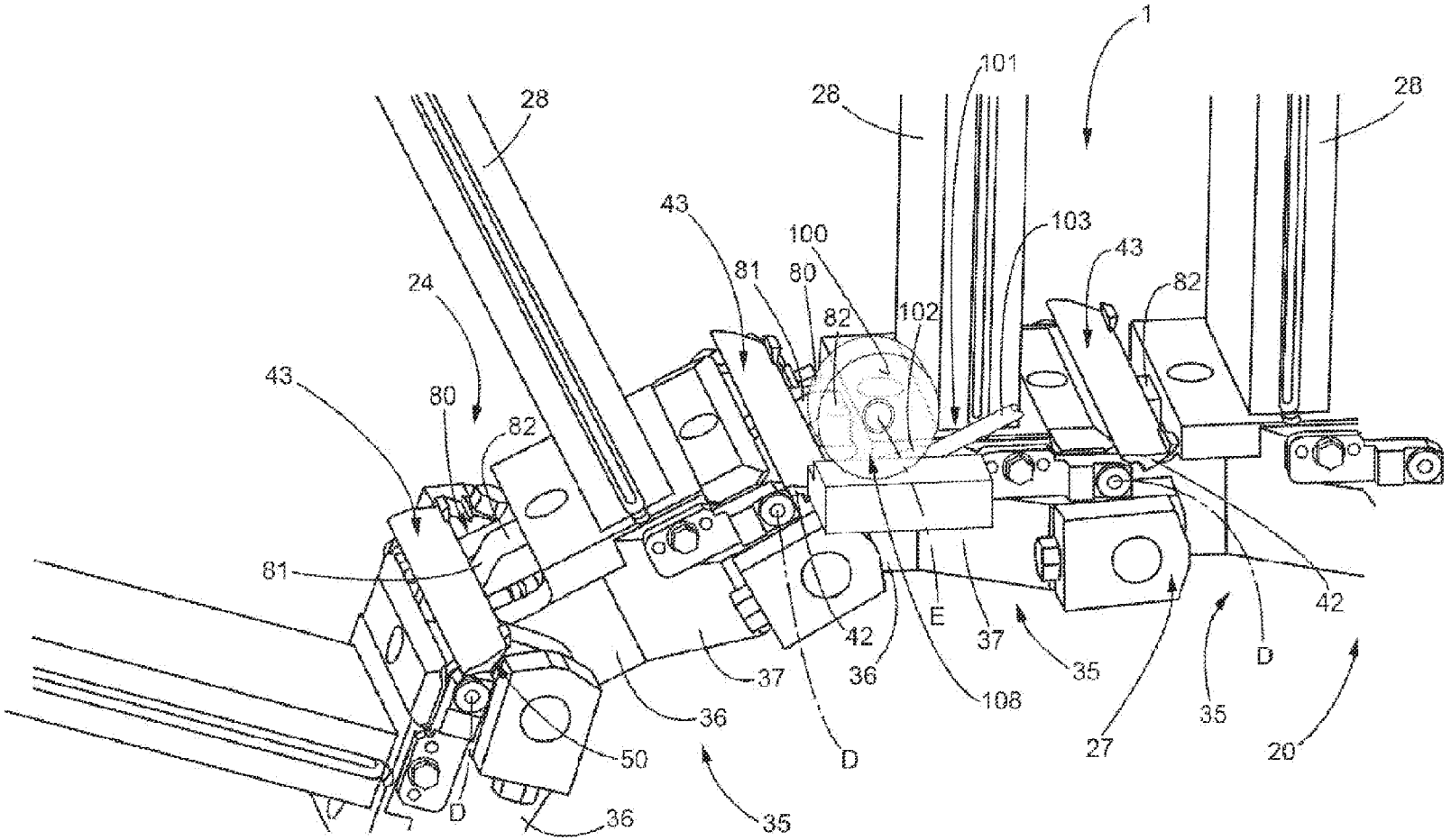
FIG. 2 shows a larger-scale perspective view of the folding unit of FIG. 1, with parts removed for clarity.

Number 1 in FIG. 1 indicates as a whole a folding unit for a packaging machine (not shown) for continuously producing parallelepiped-shaped sealed packages 2 of a pourable food product, such as pasteurized or UHT milk, fruit juice, wine, etc., from a known tube of packaging material (not shown).

The tube is formed in known manner upstream from unit 1 by longitudinally folding and sealing a known web (not shown) of heat-seal sheet material, which comprises a layer of paper material covered on both sides with layers of heat-seal plastic material, e.g. polyethylene. In the case of an aseptic package 2 for long-storage products, such as UHT milk, the packaging material comprises a layer of oxygen-barrier material, e.g. aluminium foil, which is superimposed on one or more layers of heat-seal plastic material eventually forming the inner face of the package contacting the food product.

The tube of packaging material is then filled with the food product for packaging, and is sealed and cut along equally spaced cross sections to form a number of pillow packs 3 (FIG. 9), which are then transferred to unit 1 where they are folded mechanically to form respective packages 2.

Figure 9:
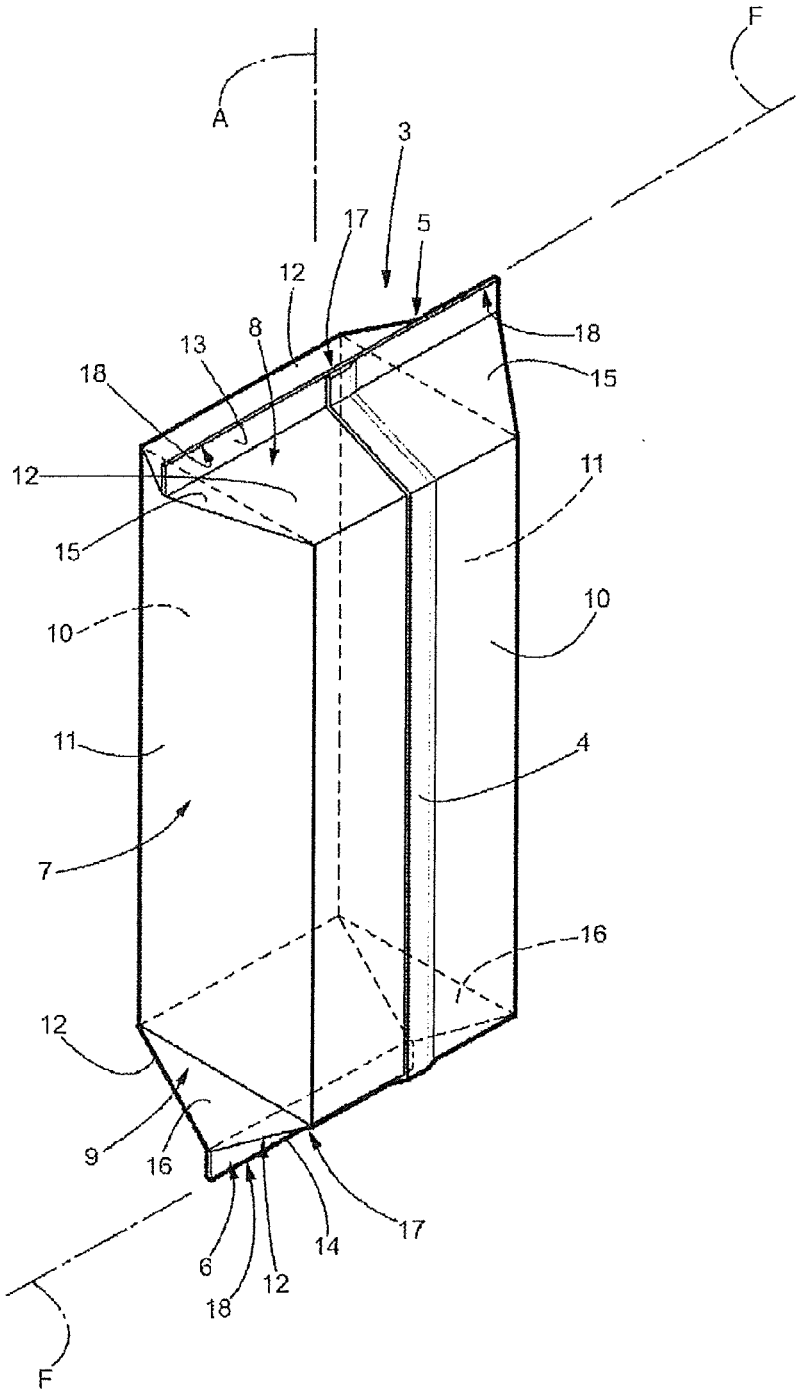
FIG. 9 shows a view in perspective of a pillow pack in the form in which it is fed to the FIG. 1 folding unit.

With reference to FIG. 9, a longitudinal sealing strip 4, formed to produce the tube of packaging material from the web folded into a cylinder, extends along one side of each pack 3, which is closed at the opposite ends by respective transverse sealing fins 5, 6 perpendicular to and joined to longitudinal sealing strip 4.

Each pack 3 has an axis A parallel to longitudinal sealing strip 4, and comprises a parallelepiped-shaped main portion 7; and opposite, respectively top and bottom, end portions 8, 9 tapering from main portion 7 towards respective transverse sealing fins 5, 6.

More specifically, main portion 7 of each pack 3 is bounded laterally by two flat rectangular walls 10 parallel to each other and to axis A, and by two flat rectangular walls 11 extending perpendicularly between walls 10.

Each end portion 8, 9 is defined by two walls 12, each substantially in the form of an isosceles trapezium, and which slope slightly towards each other with respect to a plane perpendicular to axis A, and have minor edges defined by respective end edges of walls 10 of portion 7, and major edges joined to each other by respective sealing fin 5, 6.

As shown clearly in FIG. 9, longitudinal sealing strip 4 extends between transverse sealing fins 5 and 6, and along the whole of one wall 10 and the corresponding walls 12 on the same side as wall 10.

Each sealing fin 5, 6 forms a respective substantially elongated rectangular end tab 13, 14 projecting in the direction of axis A from relative pack 3; and two substantially triangular flaps 15, 16 projecting laterally on opposite sides of main portion 7 and defined by end portions of relative walls 12.

More precisely, each end tab 13, 14 extends along a direction F orthogonal to axis A and comprises a central zone 17 and a pair of lateral zones 18.

To form a package 2, unit 1 presses end portions 8, 9 of relative pack 3 down flat towards each other, and at the same time folds respective tabs 13, 14 onto end portions 8, 9.

With reference to FIGS. 1 to 8, unit 1 substantially comprises a chain conveyor 20 for feeding packs 3 continuously along a predominantly straight horizontal forming path B from a supply station 21 to an output station 22 (both shown only schematically); and first and second folding means 23, 24, which cooperate cyclically with each pack 3 to flatten respective end portions 8, 9 of pack 3 and so fold respective tabs 13, 14 onto end portions 8, 9.

Conveyor 20 comprises at least one gear and, in the example shown, a drive gear 25 and a driven gear 26; and an articulated chain 27 looped about and meshing with gears 25, 26, and supporting a number of flat rectangular paddles 28, each of which projects from chain 27 and cooperates with and pushes a corresponding wall 10 of a relative pack 3 to feed it along path B.

Chain 27 comprises a straight horizontal top branch 30; a bottom branch 31 substantially parallel to branch 30; and two curved C-shaped portions 32, 33, which are positioned with their concavities facing, connect branches 30 and 31, and the middle portions of which define supply station 21 and output station 22 respectively.

Path B comprises a straight main portion $B_1$ defined by branch 30 of chain 27; and two, respectively supply and output, curved end portions $B_2$, $B_3$ defined by respective top portions 32*a*, 33*a* of portions 32, 33 of chain 27 extending between corresponding stations 21, 22 and branch 30. Branch 30 and portions 32*a*, 33*a* of portions 32, 33 therefore define a conveying portion of chain 27 to convey packs 3 from station 21 to station 22, while branch 31 and the remaining portions of portions 32, 33 define a return portion of chain 27 to feed paddles 28 from station 22 to station 21.

Chain 27 comprises a number of articulated links 35 defined by substantially flat rectangular plates, from which respective paddles 28 project perpendicularly. More specifically, each paddle 28 extends from an intermediate point of relative link 35, and divides the link into two roughly rectangular supporting portions 36, 37 for supporting packs 3, and which differ in length along path B and are located respectively upstream and downstream from paddle 28 along path B. More specifically, portion 37 is longer than portion 36 along path B.

Given the structure of conveyor 20, paddles 28 are positioned vertically along portion $B_1$ of path B.

Each pack 3 is positioned on conveyor 20 with end portion 9 contacting the conveying portion of chain 27, with one of walls 10 resting against relative paddle 28, and with axis A parallel to paddle 28 and crosswise to path B.

At supply station 21, each pack 3 is fed onto conveyor 20 in a feed direction C, coaxial with axis A of pack 3, and in an input position in which end portion 9 and relative end tab 14 are positioned facing the conveying portion of chain 27. Similarly, each finished package 2 is removed from conveyor 20 in a horizontal output position (not shown, by not being necessary to a clear understanding of the present invention).

More specifically, along curved portion $B_2$ of path B, given the natural spacing produced between adjacent links 35 of chain 27, end portion 9 of each pack 3 is eased onto supporting portion 37 only of relative link 35; whereas, along straight portion $B_1$ of path B, end portion 9 of each pack 3 contacts both supporting portion 37 of relative link 35 and supporting portion 36 of the preceding link 35.

With particular reference to FIG. 1, folding means 23 comprise a fixed elongated guide member 40, which is positioned facing and a distance from the conveying portion of chain 27, extends along the portion connecting portions $B_1$ and $B_2$ of path B, and defines, on the side facing chain 27, a concave cam surface converging with the conveying portion and which cooperates with end portion 8 of each pack 3 to press it down flat towards chain 27.

The action of guide member 40, combined with the force of gravity, eases packs 3 down towards the conveying portion of chain 27, thus flattening both end portions 8, 9 of packs 3.

Two fixed sides (not shown in FIG. 1), located on opposite sides of conveyor 20, provide for laterally retaining packs along path B.

Folding means 24 further comprises a plurality of movable plates 42 hinged to relative links 35 about relative axes D crosswise to path B and to axis A of relative pack 3.

With particular reference to FIGS. 3 to 7, each plate 42 defines a surface 43 adapted to cooperate with tab 14 of relative pack 3.

More precisely, as it reaches station 21, each plate 42 is arranged in a rest position (FIG. 4) in which relative surface 43 defines, on the side opposite to chain 27, with direction C an angle $\gamma$.

Furthermore, upon impact with tab 14, each plate 42 is moved, at station 21, towards a first operative position (FIG. 5) in which relative surface 43 defines an angle $\alpha$ with axis A of relative pack 3. More precisely, angle $\alpha$ is of over 90 degrees and open in direction of forming path B. In the embodiment depicted, angle $\alpha$ equals 140 degrees.

Finally, as it moves along portion $B_2$, each plate 42 is moved towards a second operative position (FIG. 7) in which relative surface 43 defines an angle $\beta$ lower than angle $\alpha$ with axis A of relative pack 3.

Due to the fact that angle $\beta$ is lower than angle $\alpha$, each surface 43 folds partially tab 14 towards relative pack 3 while moving from first to second operative position.

Preferably, the rotation angle of surface 43 between first and second operative position, i.e. the angle $\alpha$-$\beta$, ranges between 40 and 50 degrees, and equals, in the embodiment depicted, 45 degrees.

Folding means 24 advantageously comprise a plurality of cams 80 carried by chain 27 and each cooperating, in use, with a relative plate 42 for moving relative surface 43 between relative first and second operative positions.

More precisely, cams 80 cooperate with surfaces 50 opposite to surface 43 of relative plates 42.

In greater detail, each cam 80 is carried by portion 37 of a relative first link 35 and cooperates with surface 43 of a relative plate 42 carried by portion 36 of a second link 35 immediately upstream from first link 35 with reference to the advancing direction of chain 27.

In this way, as first and second link 35 moves one with respect to another along the curved portion $B_1$ of path B, each plate 42 slides onto corresponding cam 80, thus causing the rotation of relative surface 43 from relative first to relative second position.

Furthermore, each cam 80 comprises substantially a first surface 81 and a second surfaces 82 interacting with surface 50 and sloped with respect to one another (FIGS. 4 to 8).

More precisely, surface 81 is arranged upstream from relative surface 82 with reference to the advancing direction of chain 27.

In other words, as moving along portion $B_1$, each plate 42 at first cooperate with surface 81 and then with surface 82.

As it describes portion $B_1$ of path B, surface 82 is substantially parallel to portion $B_1$ while surface 81 is sloped with respect to and ascending towards surface 82.

Folding means 24 further comprise (FIGS. 1 and 2):

- a pair of idle wheels 100 supported by a fixed structure (not shown) of folding unit 1 and rotatable about a common axis E; and
- a pair of rails 101 converging towards guide member 40, and each comprising a portion 102 arranged below respective wheels 100 and respective portions 103, which are arranged downstream from portions 102 proceeding according to the advancing direction of packs 3 along portion $B_1$.

More precisely, wheels 100 and rails 101 are arranged on respective opposite lateral sides of chain 27.

Axis E is substantially orthogonal to plane on which path B lies, portions 102 are sloped with respect to branch 30, and portions 103 are sloped both with respect to portions 102 and to branch 30.

More precisely, proceeding according to the advancing direction of packs 3 along portion $B_1$, portions 102 approach axis E and portions 103 approach branch 30.

In other words, both portions 102 and portions 103 are ascendant.

Wheels 100 and portions 102 of corresponding rails 101 define respective passages 108, through which lateral zones 18 of packs 3 cyclically pass.

Furthermore, wheels 100 and portions 102, 103 are arranged at an end of portion $B_2$ of path B adjacent to portion $B_1$.

Due to the fact that rails 101 converge towards guide member 40, as they pass through passages 108, lateral zones 18 of each pack 3 are partially folded towards main portion 7 of pack 3 together with central zone 17 of such pack 3.

At the same time, flaps 16 of each pack 3 are pressed by wheels 100 towards rails 101.

As they slide onto portions 103 of rails 101, lateral zones 18 of each pack 3 are completely folded onto main portion 7 of pack 3.

Operation of unit 1 will be described with reference to one pack 3 and as of an initial instant, in which pack 3 is fed in direction C onto portion 37 of a relative link 35 of chain 27 of conveyor 20.

Figure 3:
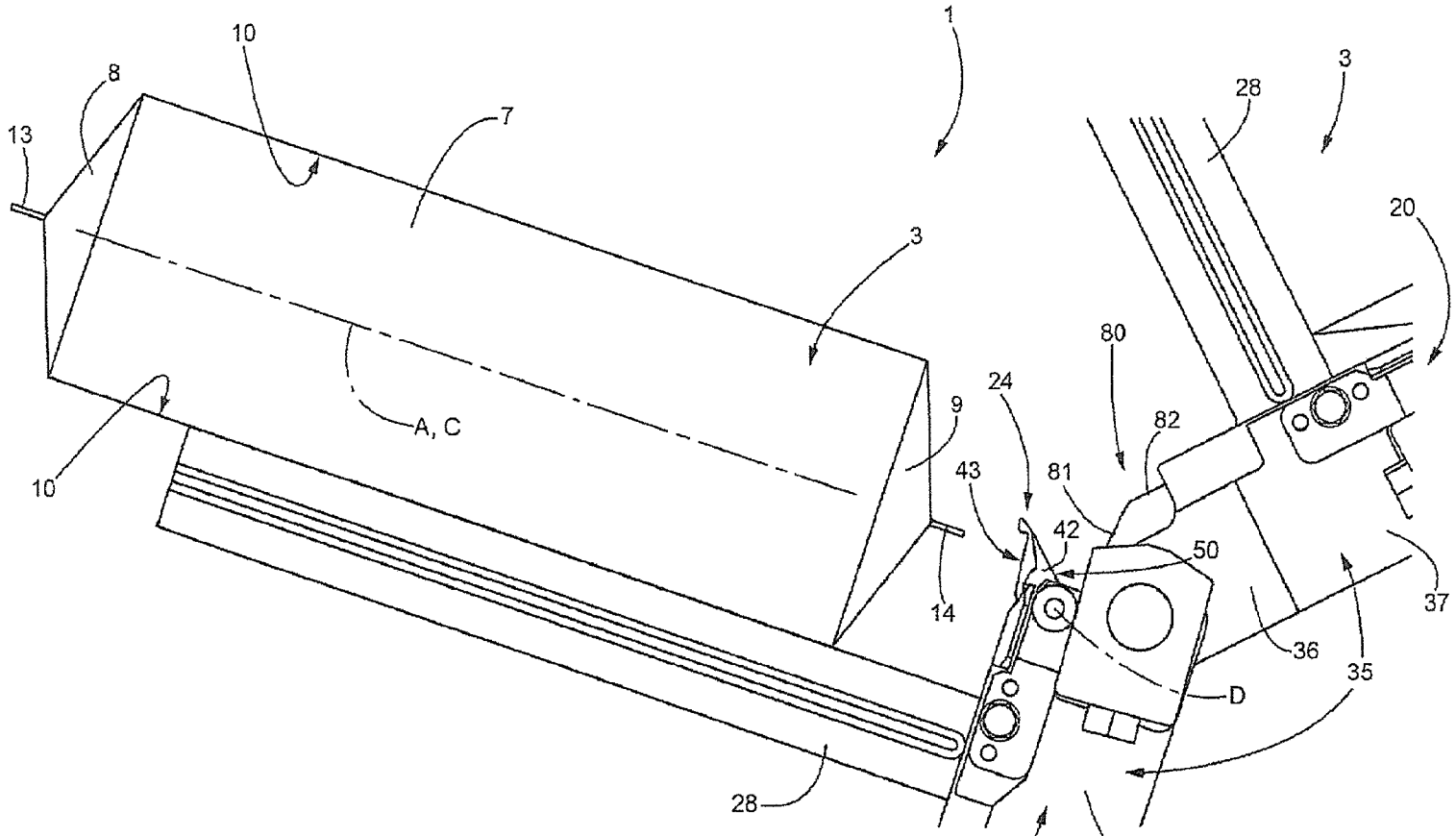
FIGS. 3 to 8 show larger-scale side views of a pillow pack folding sequence performed along a portion of the pack feed path, with parts removed for clarity.

As shown particularly in FIGS. 1 and 3, pack 3 is positioned with end tab 14 facing portion 37 of link 35, and slides on one wall 10 along relative paddle 28 so that tab 14 is parallel to paddle 28.

Figure 4:
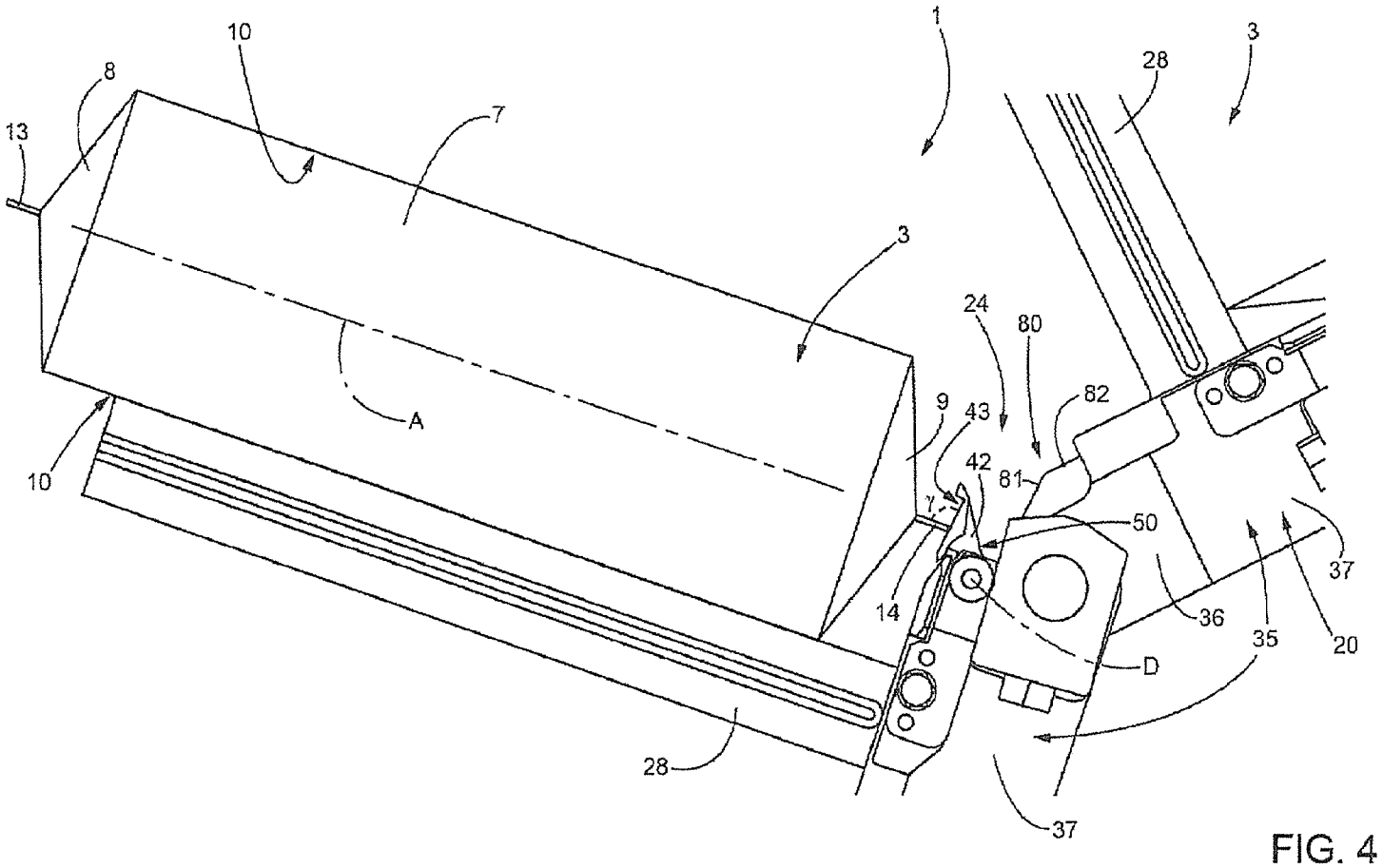

As it reaches supply station 21, plate 42 of link 35 is arranged in the rest position (FIG. 4).

Figure 5:
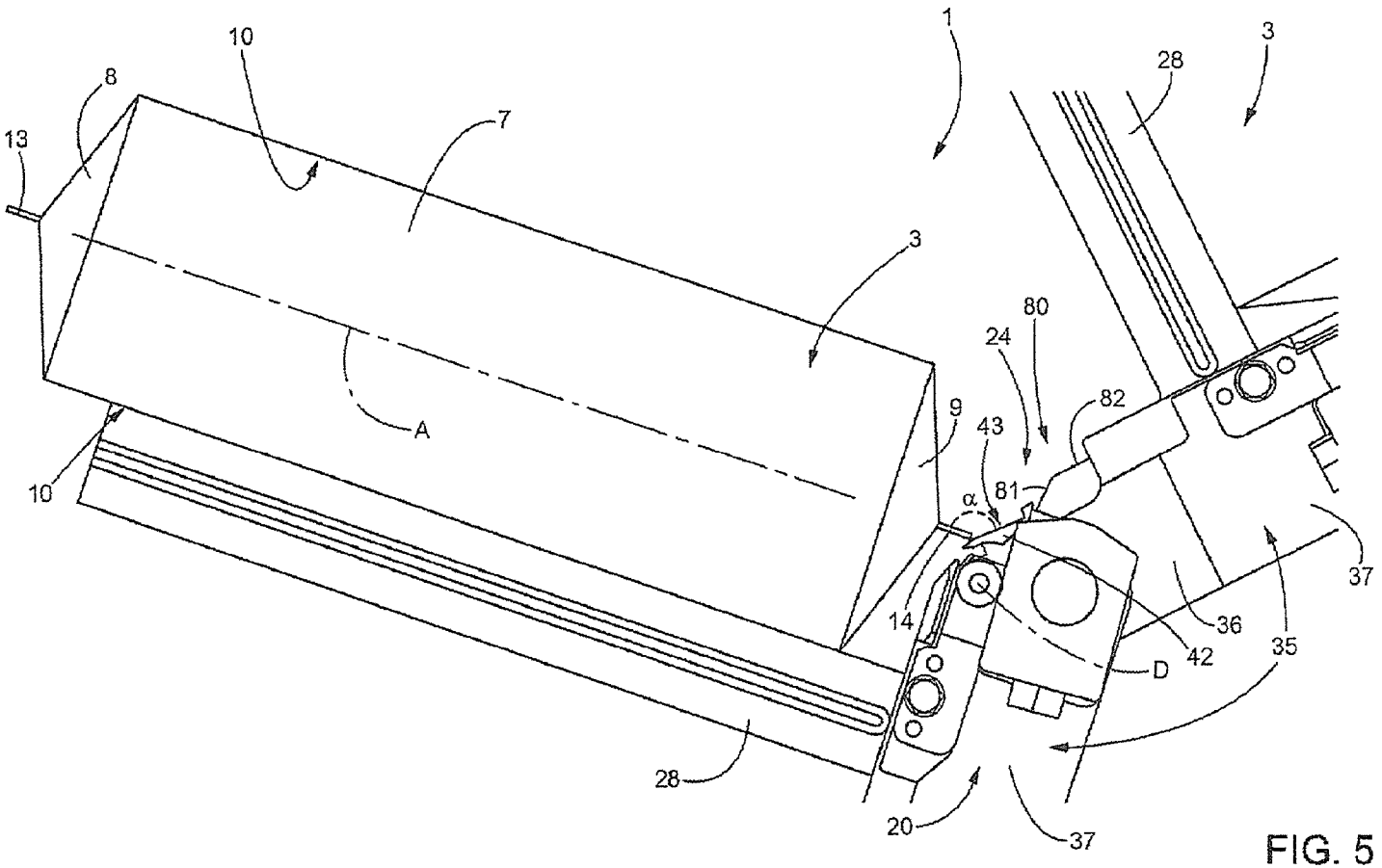

Upon impact with pack 3 at supply station 21 (FIG. 4), plate 42 of link 35 rotates clockwise about axis D, so as to reach first operative position (FIG. 5).

The movement of paddle 28 and the thrust exerted by it up-end pack 3 along portion $B_2$ of path B into an upright position by the start of portion $B_1$ of path B. During which movement, end portion 8 of pack 3 cooperates in sliding manner with guide member 40, which, as stated, converges with chain 27 and so combines with chain 27 to press end portions 8 and 9 down flat.

Figure 6:
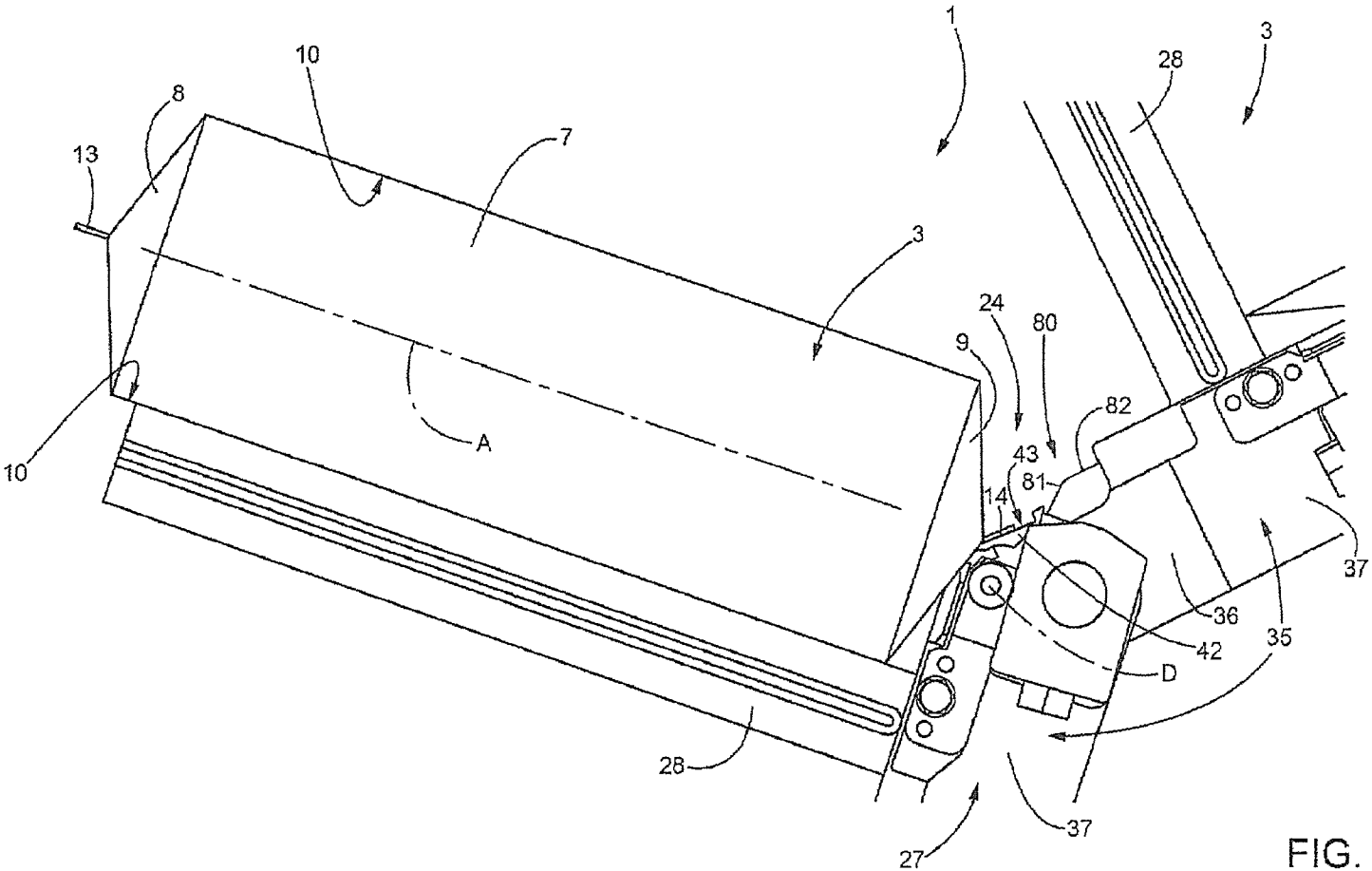
Figure 7:
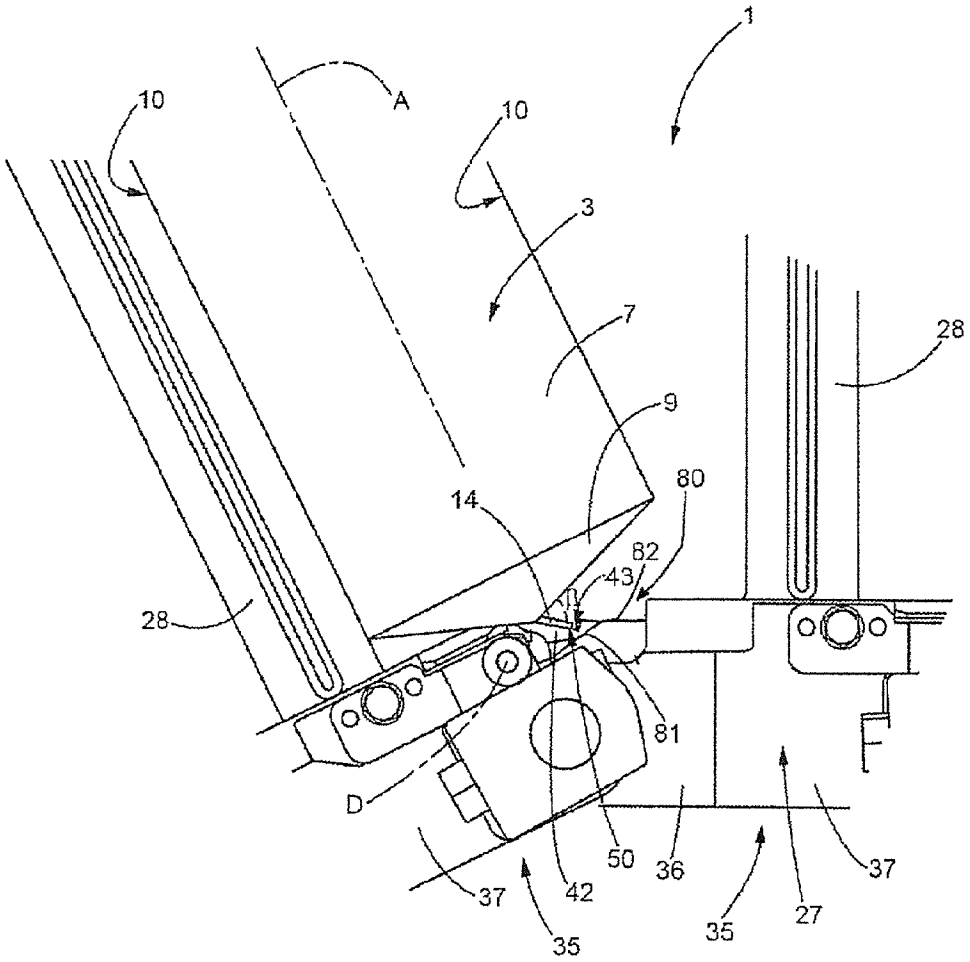
Figure 8:
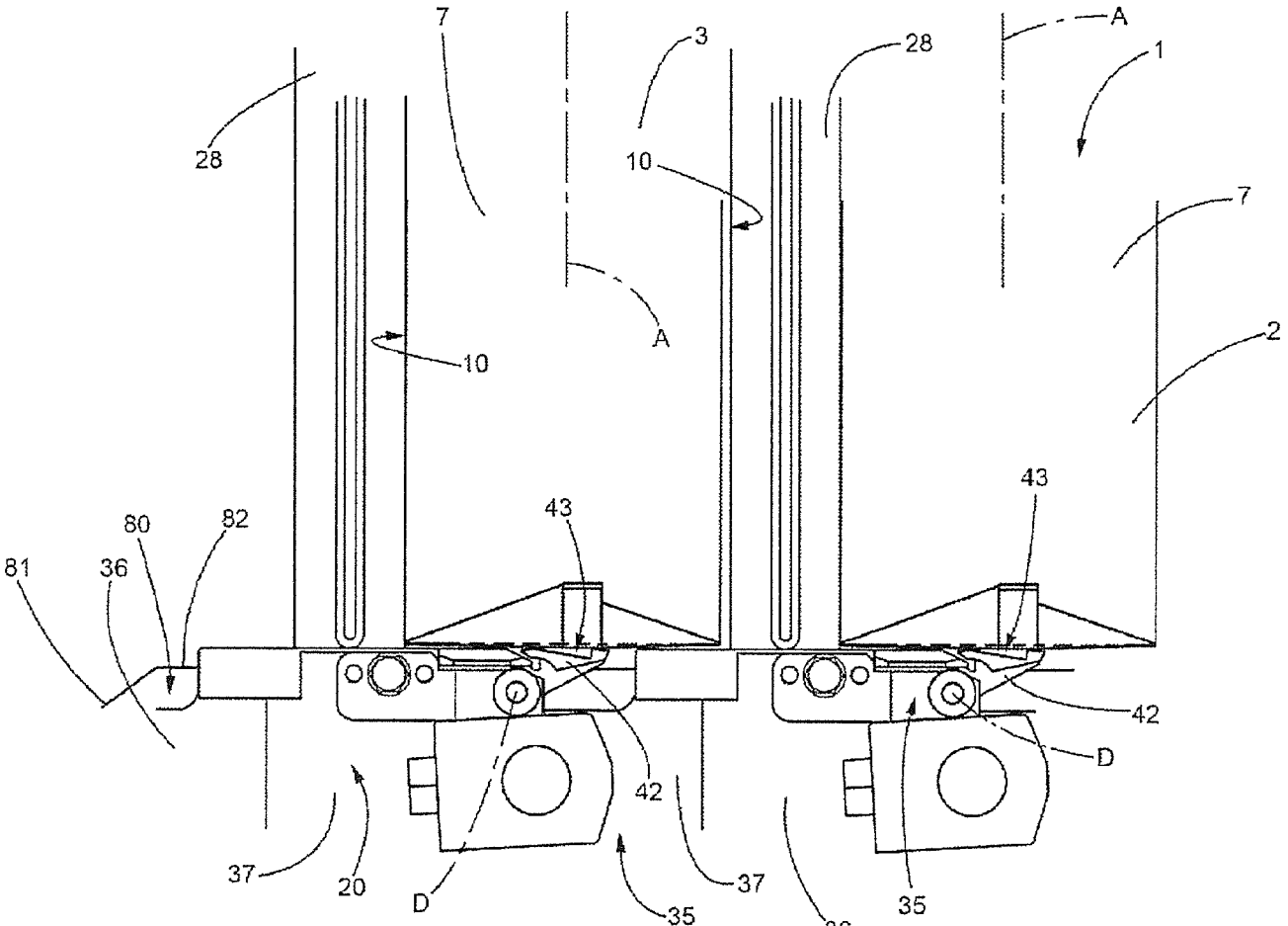

As this is taking place, plate 42 slides onto first and second surface 81, 82 of corresponding cam 80 carried by the link 35 arranged immediately downstream along path B. Due to the conformation of cam 80, plate 42 is moved from the first operative position to the second operative position (FIGS. 6 and 7).

Accordingly, central zone 17 of tab 14 is folded towards main portion 7 of pack 3.

As this is taking place, lateral zones 18 of tab 14 pass through passages 108, slide onto portions 102 of rails 101 and are partially folded onto main portion 7 of pack 3.

More precisely, flaps 16 of pack 3 cooperate with wheels 100, and lateral zones 18 are folded by portions 102 towards main portion 7.

Afterwards, link 35 moves along portion $B_1$ of path B and partially folded lateral zones 18 of tab 14 slide onto portions 103 of rail 101.

Due to the fact that portions 103 are ascendant and converge towards guide member 40, lateral zones 18 are completely folded onto main portion 7 of pack 3.

Complete folding of lateral zone 18 causes the complete folding of central zone 17 onto main portion 7 of pack 3.

Once tab 14 has been completely folded onto main portion 7, pack 3 may undergo further forming operations, not described or illustrated by not forming part of the present invention, and is then unloaded off conveyor 20 at output station 22.

Once free of pack 3, link 35 is arranged in the rest position by its weight and is fed back to supply station 21.

The advantages of unit 1 according to the present invention will be clear from the foregoing description.

In particular, due to the fact that cams 80 are carried by chain 27, it is possible to rotate the plate 42 and, therefore, surface 43 for an angle greater than the rotation angle of impact surfaces of the folding unit described in the introductory part of the present description.

As a result of such particularly increased rotation angle of plate 42 between its first and second operating positions, end tab 14 substantially slides onto surface 43 arranged in the first operative position, instead of impacting against relative link 35.

Accordingly, as the folding of end tab 14 does not rely substantially on the impact between end tabs 14 and surfaces 43, folding unit 1 ensures the folding of end tabs 14 even when the speed of packs 3 is particularly low, i.e. when the packaging machine has a relatively low rate.

In this way, the mechanical stresses on packs 3 are reduced and the overall quality of the folded packages 2 is highly improved.

For the same reasons, even end tabs 14 of pack 3 made by a wide range of packaging material, especially particularly hard packaging material, are efficiently folded by unit 1.

Finally, the maximum lift of plates 42 with respect to relative axes D may be easily varied by simply modifying the shape of cams 80.

Accordingly, it is possible to fold different kind of packages 2 having end tabs 14 more or less pressed onto main portion 7 by modifying the shape of cams 80.

Clearly, changes may be made to unit 1 without, however, departing from the protective scope defined in the accompanying Claims.

The invention claimed is:

1. A folding unit for producing packages of pourable food products from sealed packs having each a longitudinal first axis and comprising at least one first end tab to be folded and which projects in the direction of said longitudinal first axis; said first end tab comprising, along a direction transversal to said first axis, a central zone and a pair of lateral zones arranged on opposite sides of said central zone;

said unit comprising:

a movable conveying member which is fed with a plurality of said packs, by the ends corresponding to said first end tabs, and which feeds the pack along a forming path; and folding means which interact with each said pack along said forming path to fold said first end tab onto said pack;

said folding means comprising a plurality of plates carried by said conveying member and comprising, in turn, respective first surfaces;

each said first surface cooperating, in use, with at least said central zone of said first end tab to be folded of a pack, and being movable between a first position and a second position with respect to said pack with which it cooperates, so as to fold at least said central zone of said first end tab onto said pack;

wherein said folding means comprise a plurality of cams carried by said conveying member and each cooperating, in use, with a said plate to move said first surface between said first and second positions.

2. A folding unit according to claim 1, wherein said conveying member comprises a plurality of consecutive links articulated with respect to one another; each said first surface being rotatable with respect to a first said link and corresponding said cam being fixed to a second said link immediately consecutive to said first link and downstream from said first link, proceeding according to an advancing direction of said packs along said path.

3. A folding unit according to claim 2, wherein each cam comprises a first cam surface and a second cam surface sloped with respect to one another, and cooperating, in use, with said first surface.

4. A folding unit according to claim 2 wherein said conveying member is a chain conveyor.

5. A folding unit according to claim 1, comprising further folding means which cyclically interact, in use, with a second end tab of each pack along said forming path; said second end tab being opposed to said first end tab.

6. A folding unit according to claim 5, comprising:

a pair of wheels arranged on opposite sides of said conveying member and rotatable along a second axis which is fixed with respect to said conveying member; and a pair of rails converging towards said further folding member, fixed with respect to said conveying member and arranged on opposite sides of said conveying member;

said wheels and said rails defining respective passages which are, in use, cyclically crossed by said lateral zones of the first end tab of each pack;

said wheels being adapted to cyclically cooperate with respective flaps interposed between a main portion and said first end tab of each pack, and said rails being adapted to cyclically cooperate with said lateral zones of said first end tab to fold said lateral zone of such first end tab towards said main portion.

7. A folding unit according to claim 6, wherein said rails comprise first portions facing respective said wheels and defining respective said passages therewith, and second portions arranged downstream from said first portions, proceeding according to said advancing direction of said packs along said path;

said second portions cyclically cooperating, in use, with said lateral zones of each pack to complete the folding of said first end tab onto said pack.

8. A folding unit according to claim 7, wherein said path comprises a curved supply portion along which each first plate cooperates with and moves with respect to said corresponding cam, and a main straight portion arranged downstream from said supply portion, proceeding according to said advancing direction of said packs along said path;

said wheels and at least said first portion of said rails being arranged at an end of said supply portion adjacent to said main portion.

* * * * *